United States Patent [19]

Reiniche et al.

[11] 4,184,002

[45] Jan. 15, 1980

[54] UNDULATED METALLIC ELEMENTS FOR THE REINFORCEMENT OF COMPOSITE MATERIALS

[75] Inventors: André Reiniche, Clermont-Ferrand; Philippe Sauvage, Chateaugay, both of France

[73] Assignee: Compagnie Generale des Etablissements Michelin, Clermont-Ferrand, France

[21] Appl. No.: 910,845

[22] Filed: May 30, 1978

[30] Foreign Application Priority Data

Jun. 6, 1977 [FR] France ..... 77 17481

[51] Int. Cl.[2] ..... B21D 13/00

[52] U.S. Cl. ..... 428/603; 428/604; 52/630

[58] Field of Search ..... 428/603, 604; 52/630

[56] References Cited

U.S. PATENT DOCUMENTS

| | | | |
|---|---|---|---|
| 358,889 | 3/1887 | Sagendorph | 428/604 |
| 2,457,420 | 12/1948 | Veeder | 428/603 |
| 3,224,205 | 12/1965 | Greiner et al. | 52/630 |
| 3,390,968 | 7/1968 | Brown | 428/603 |

FOREIGN PATENT DOCUMENTS

| | | | |
|---|---|---|---|
| 2757 | of 1853 | United Kingdom | 428/603 |

*Primary Examiner*—Brooks H. Hunt

*Attorney, Agent, or Firm*—Brumbaugh, Graves, Donohue & Raymond

[57] ABSTRACT

Filiform elements, particularly of steel, intended for the reinforcement of agglomerates are improved due to the fact that these elements have a nearly rectangular cross-section and are undulated perpendicular to their longitudinal axis and parallel to the largest dimension of their cross-section.

5 Claims, 4 Drawing Figures

UNDULATED METALLIC ELEMENTS FOR THE REINFORCEMENT OF COMPOSITE MATERIALS

This invention relates to improvements in reinforcement elements intended to be incorporated in agglomerates of materials for improving their strength. By agglomerates there are understood mixtures of several materials, for example, sand or gravel with a binder such as cement and/or lime and/or resins.

It is already known to replace in these agglomerates the continuous reinforcement elements, customarily iron bars of circular cross-section arranged in suitable manner, by a dispersion of filiform elements of small diameter, which elements may possibly be oriented in the direction of the reinforcement desired.

However, the adherence between these filiform elements and the components of the agglomerate is not satisfactory. This drawback is ascribed essentially to the disproportion present between the average diameter of the filiform elements and the particle size of the components of the agglomerate.

An improvement has been obtained by providing the filiform elements with terminal protuberances. However, experience shows that beyond a certain stress the anchoring between these elements and the agglomerate also finally fails.

The object of the present invention consists in improving the anchoring of such filiform elements of small cross-section by acting on the shape of said elements.

Thus, the filiform elements in accordance with the invention, which are particularly of steel and are intended for the reinforcement of agglomerates, are characterized by the fact that said elements have a nearly rectangular cross-section and are undulated perpendicular to their longitudinal axis and parallel to the largest dimension of their cross-section.

The undulations of the filiform elements or ribbons in accordance with the invention may also be replaced by sawteeth which are regular or irregular with respect to their spacing and their size, and/or by crenations which may or may not be equidistant and may or may not be of the same size.

One simple method of producing such transversely undulated filiform elements or ribbons consists in feeding a metal sheet, for instance a steel sheet, at constant speed to shears having a frequency of cutting which is adapted to the speed of feed, the knife and the counter-knife of the shears having an undulated contour instead of having the customary linear contour.

Examples of filiform elements or ribbons in accordance with the invention are described below with reference to the drawing, in which.

Figure 1:
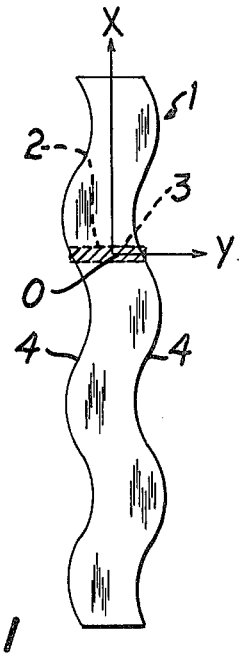
FIG. 1 is a view in elevation of an undulated ribbon.

The longitudinal axis OX of the ribbon 1 has been shown in FIG. 1. The transverse axis OY contained within the nearly rectangular cross-section 2 (shown in dashed line) is perpendicular to the axis OX and parallel to the largest dimension 3 of the cross-section 2.

The undulations of the edges 4 of the ribbon are parallel to the axis OY and perpendicular to the axis OX.

Figure 2:
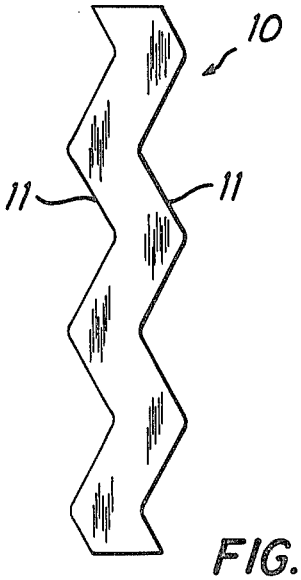
FIG. 2 is a view similar to FIG. 1 of a ribbon having a broken-line contour.

The ribbon 10 illustrated in FIG. 2 differs from the one shown in FIG. 1 only by the fact that its edges 11 are in the shape of a broken line instead of being undulated.

Figure 3:
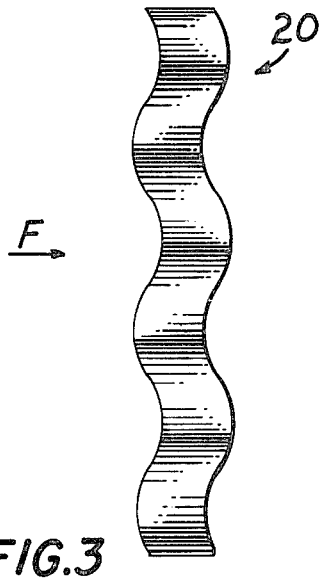
FIG. 3 is a view in elevation of a doubly undulated ribbon.
Figure 4:
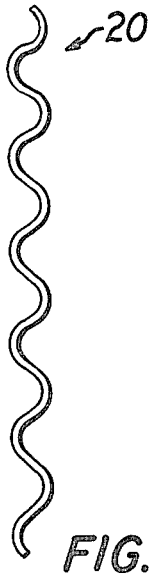
FIG. 4 is a view of the ribbon of FIG. 3 seen in the direction of the arrow F in FIG. 3.

By passing transversely undulated ribbons, such as those in FIGS. 1 and 2, between two grooved rollers turning in opposite direction, one obtains doubly undulated ribbons 20, such as the one shown in FIGS. 3 and 4.

Using the same cross-section of metal as reinforcement in a concrete, an improvement in strength of 50% has been obtained as compared with substantially linear, circular, filiform elements having terminal protuberances.

What is claimed is:

1. Filiform elements, particularly of steel, intended for the reinforcement of agglomerates, characterized by the fact that said elements have a nearly rectangular cross-section and are undulated perpendicular to their longitudinal axis and parallel to the largest dimension of their cross-section.

2. Filiform elements according to claim 1, characterized by the fact that said elements are also undulated in a direction parallel to the smallest dimension of their cross-section.

3. Use of filiform elements according to claim 1 or 2 as reinforcement elements for agglomerates.

4. Process of manufacturing filiform elements according to claim 1, characterized by feeding a metal sheet at constant speed to shears having a frequency of cutting which is adapted to the speed of feed, the knife and the counter-knife of the shears being of undulated contour.

5. Process of manufacturing filiform elements according to claim 2, characterized by feeding a metal sheet at constant speed to shears having a frequency of cutting which is adapted to the speed of feed, the knife and the counter-knife of the shears being of undulated contour and passing the resulting transversely undulated filiform elements between two grooved rollers turning in opposite directions.

* * * * *